United States Patent [19]

Pacht

[11] Patent Number: 4,551,077

[45] Date of Patent: Nov. 5, 1985

[54] HIGH PRESSURE PUMP

[75] Inventor: Amos Pacht, Houston, Tex.

[73] Assignee: Butterworth Inc., Florham Park, N.J.

[21] Appl. No.: 592,395

[22] Filed: Mar. 22, 1984

[51] Int. Cl.[4] ..... F04B 21/02; F04B 21/08; F16J 15/18

[52] U.S. Cl. ..... 417/454; 417/539; 92/168; 92/171

[58] Field of Search ..... 92/171, 168; 417/454, 417/539

[56] References Cited

U.S. PATENT DOCUMENTS

| | | | |
|---|---|---|---|
| 3,216,365 | 11/1965 | Deffinger et al. | 92/171 |
| 3,314,337 | 4/1967 | Dayne et al. | 92/171 |
| 3,372,648 | 3/1968 | Hammelmann | 417/567 |
| 3,373,695 | 3/1968 | Yohpe | 417/454 |
| 3,817,663 | 6/1974 | Zehner | 417/454 |
| 3,820,922 | 6/1974 | Buse | 417/539 |
| 4,141,676 | 2/1979 | Jannen | 417/539 |
| 4,239,463 | 12/1980 | Yaindl | 417/539 |
| 4,258,612 | 3/1981 | Kuhlmann | 92/171 |

*Primary Examiner*—William L. Freeh

*Attorney, Agent, or Firm*—Donald F. Wohlers

[57] ABSTRACT

An inline valve pump design is provided wherein the suction and the discharge valves operate along a central axis coincident and inline with a reciprocating plunger. The reciprocating plunger operates within a cylinder and a stuffing box which are independently secured by separate securing means to the drive housing of the pump. The cylinder thus secured by these independent securing means to the pump housing is also provided with an outer end having a large threaded portion to which a mounting adapter ring is secured. This ring in turn provides the mounted base to which further securing means, independent of the securing means holding the cylinder and stuffing box to the drive housing, are attached. These second or further securing means are effective to attach the suction and discharge manifold assemblies to the head of the cylinder, and in so doing capture the inline suction and discharge valve assembly to the cylinder head. This structural arrangement of the pump elements into, in effect, two separate and independently maintainable subassemblies, allows for easy maintenance and disassembly of the fluid end of the pump without disassembling the power end of the pump incorporating the cylinder and stuffing box means attached to the drive housing. Another aspect of the present invention is that an optimized arrangement of passageways and suction valve return spring location is employed to enhance the volumetric efficiency of the pump.

14 Claims, 4 Drawing Figures

HIGH PRESSURE PUMP

BACKGROUND OF THE INVENTION

This invention relates to an improved high pressure fluid reciprocating pump. Pumps of this type are typically used in high pressure fluid delivery systems to create a high pressure water jet, as for cleaning. Examples of pumps for such service will be seen in U.S. Pat. No. 4,277,229 to Pacht and U.S. Pat. No. 3,811,801 to Buse et al. Reciprocating pumps of this type generally include a plurality of plungers and cylinders and develop pressures in excess of 10,000 psi frequently subjecting their parts to significant stresses and fatigue failure due to stress fluctuations. Accordingly, due to the severe service environment of high pressure pumps of this type, maintenance thereof may be frequently required, particularly to the pressure end of the pump. Therefore, minimizing stress concentration points along with ease of maintenance, durability of construction, are all exceedingly important in determining the overall service performance of high pressure pumps.

In the Buse et al reference mentioned above, an inline valve pump superficially suggestive of applicant's present overall arrangement is shown in that ease of maintenance is a consideration underlining its design. However, with all such high pressure pumps, a considerable amount of input energy is required and it is therefore highly desirable to also increase the efficiency of the pump as well as its ease of maintenance. As will be described below, the pump of the present invention has features which not only provide increased ease of maintenance over the prior art, but also substantially raise the volumetric efficiency of the pump to thereby reduce the necessary energy input for a given pressure and volume output.

SUMMARY OF THE INVENTION

In accordance with the present invention, an inline valve pump design is provided wherein the suction and the discharge valves operate along a central axis coincident and inline with a reciprocating plunger. In accordance with the present invention, the reciprocating plunger operates within a cylinder and a stuffing box which are independently secured by separate securing means to the drive housing of the pump. The cylinder thus secured by these independent securing means to the pump housing is also provided with an outer end having a large threaded portion to which a mounting adapter ring is secured. This ring in turn provides the mounted base to which further securing means, independent of the securing means holding the cylinder and stuffing box to the drive housing, are attached. These second or further securing means are effective to attach the suction and discharge manifold assemblies to the head of the cylinder, and in so doing capture the inline suction and discharge valve assembly to the cylinder head. This structural arrangement of the pump elements into, in effect, two separate and independently maintainable subassemblies, allows for easy maintenance and disassembly of the fluid end of the pump without disassembling the power end of the pump incorporating the cylinder and stuffing box means attached to the drive housing. Alternatively, this arrangement also permits maintenance upon the cylinder and stuffing box means without the necessary disassembly or disturbance to the fluid end of the pump incorporating the suction and discharge valves in the event that maintenance thereof is not required at the same time that maintenance of the stuffing box may be required.

Another aspect of the present invention is that an optimized arrangement of passageways and suction valve configuration is employed to enhance the volumetric efficiency of the pump. As is recognized, a most important design consideration for high volumetric efficiency is to lower the suction stroke flow resistance within the pump. This is accomplished in applicant's design by the elimination, as much as possible, of sharp turns in the suction fluid flow path since each directional change will contribute to the overall flow restriction in the suction flow path. Furthermore, volumetric efficiency of the pump is enhanced by physically removing the location of the suction valve return spring from the suction flow path and placing it rather in the discharge flow path wherein its presence will have little or no effect upon the suction stroke flow resistance. Therefore, in applicant's novel arrangement, a helical suction valve spring is chosen to have a relatively small helical diameter and is located as close to the center axis as possible of the suction valve. In this way, not only is the suction valve return spring removed from the fluid flow path into the cylinder during the suction stroke of the pump plunger, but its relatively small overall diameter if effective to centrally concentrate its return spring force along and as close to the center axis of the suction valve as possible. This has the further advantage that it concentrates the spring load over the least end area of the suction valve as opposed to using a larger diameter helical spring as in Buse et al which has the susceptibility of applying an uneven end force over a larger end area of the suction valve, which inherently will create a greater susceptibility to cocking and wear of the suction valve upon return to its seated position. It will thus be seen that the small diameter suction valve return spring therefore has the dual advantage of raising the volumetric efficiency of the pump, not only by removing itself from the suction flow path into the chamber, but in addition assuring rapid and positive closing of the suction valve upon start of the discharge stroke of the plunger which also is essential for good volumetric efficiency.

Accordingly, it is a principal object of the invention to provide a reliable inline valve pump design requiring a minimum of field maintenance, but when required to allow such maintenance to be readily accomplished upon the effected area of the pump without requiring total disassembly thereof. Another object of the invention is to provide a novel pump design which has the additional advantage that the suction and discharge valves and their associated valve seats may be replaced, as a matched unit or assembly, quickly and easily in the field.

A further object of the invention is to provide a multiple plunger inline reciprocating pump with a novel overall structural arrangement that affords economy in manufacture, servicing, and field maintenance.

A still further object of the invention is to provide a suction valve assembly arrangement which optimizes pump volumetric efficiency.

These and other objects and advantages of the invention will become apparent, and the invention will be fully understood from the following description and drawings in which:

BRIEF DESCRIPTION OF THE DRAWINGS

Referring to FIG. 1, a multi-plunger reciprocating pump 10 is shown. The pump 10 includes a drive housing 12 connected to a suitable drive motor or engine 14. The pump 10 includes a fluid end portion including an intake or suction manifold 16 connected to a suitable liquid inlet conduit 17 and a high pressure discharge manifold 18 connected to a fluid discharge conduit or hose 20. As is conventional in water jetting or blasting systems, the discharge conduit hose 20 would be connected to any suitable water jetting gun as indicated generally at 22.

Figures 1, 2:
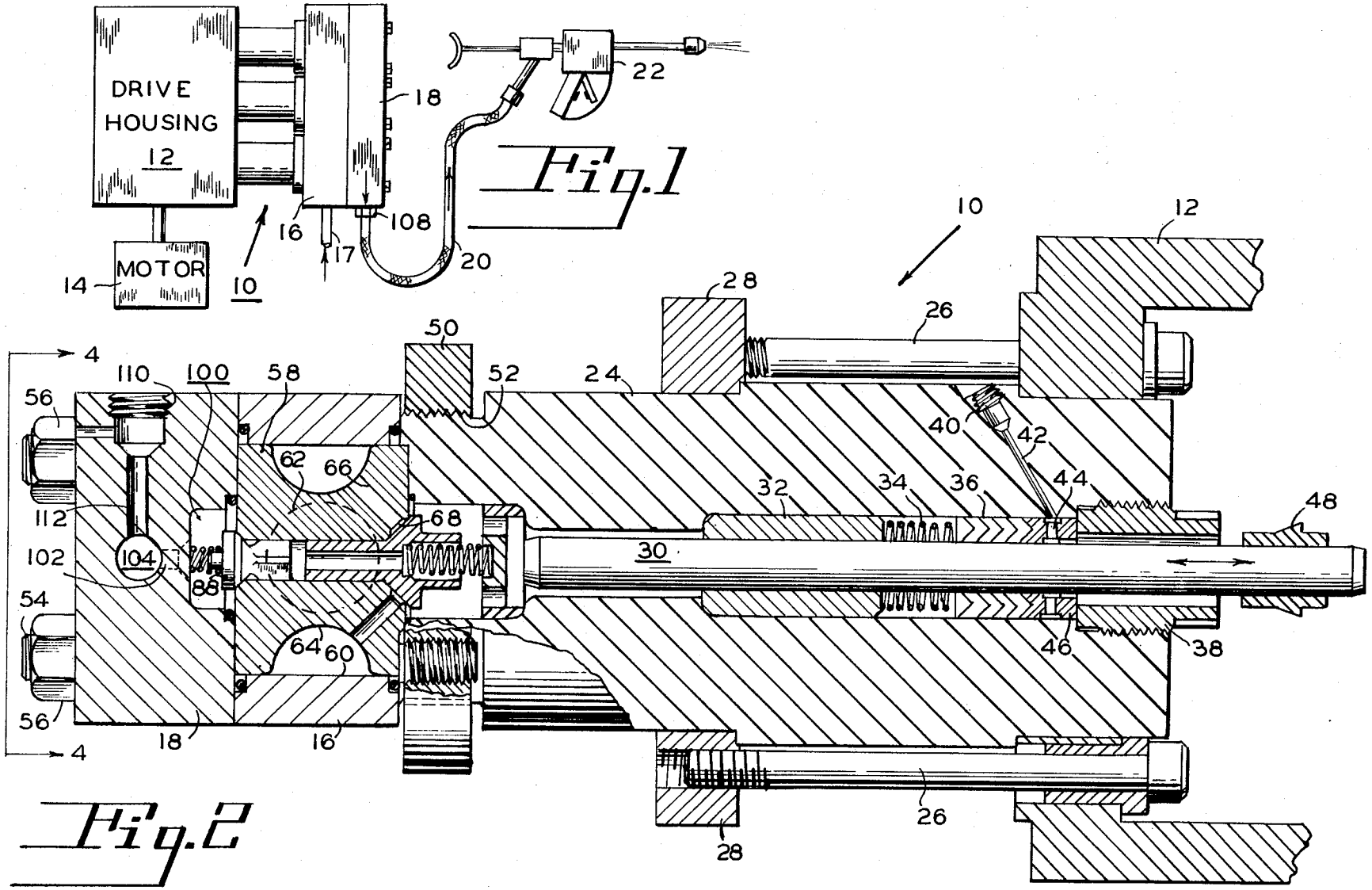
FIG. 1 is a diagrammatic drawing of a high pressure water jetting system utilizing the pump of the present invention.
FIG. 2 is a cross-sectional view of a pump in accordance with the invention as it would be attached to a pump drive housing.
Figure 3:
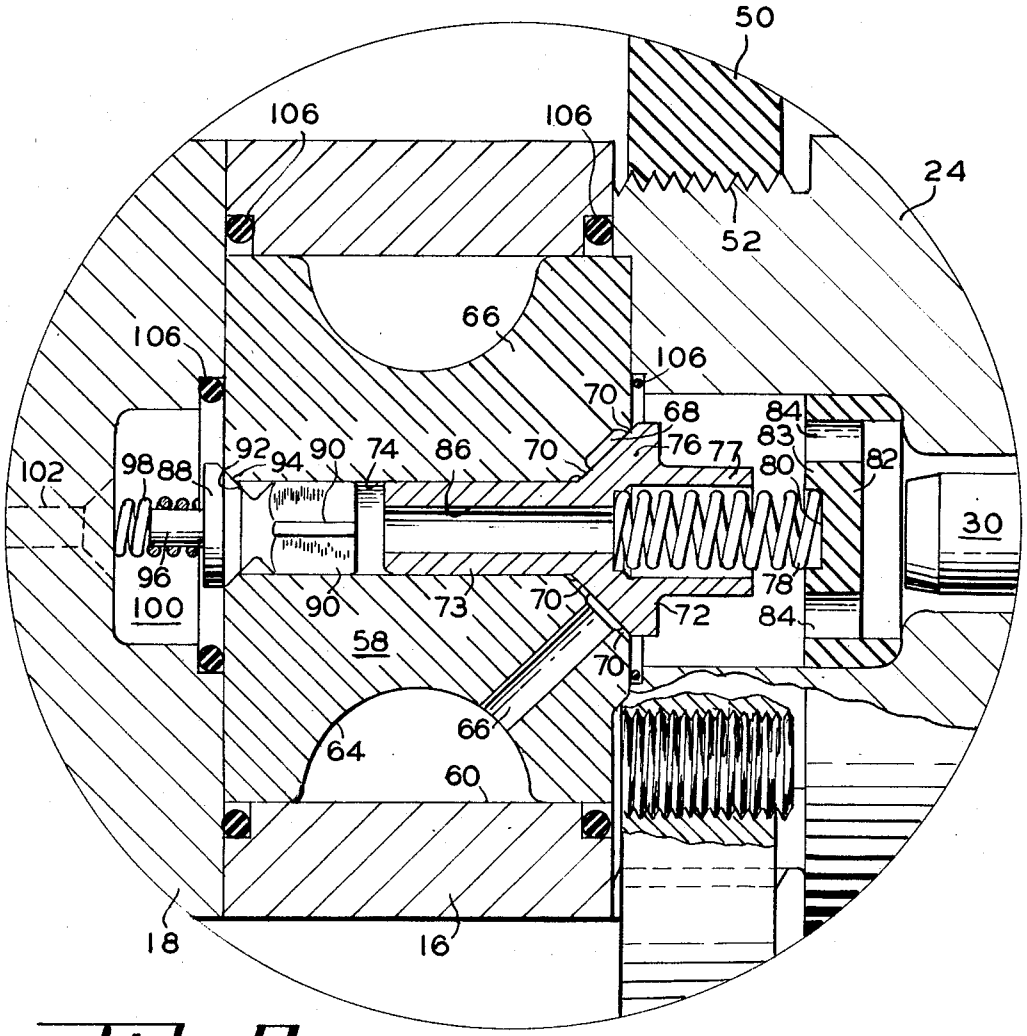
FIG. 3 is an enlarged cross-sectional view of the suction and discharge valve assembly shown in FIG. 2.

Referring more specifically to FIGS. 2 and 3, an individual pump cylinder 24 of the 3-cylinder pump shown generally in FIG. 1, is shown in cross-section. The cylinders 24, referred to hereafter as cylinder and stuffing box means, are each independently secured to the drive housing 12 by a plurality of cap screws 26, which extend through suitable apertures in the housing 12 and threadably engage a cylinder clamp plate 28 surrounding the cylinder 24. Each cylinder and stuffing box means includes a reciprocating piston or plunger 30 suitably supported and guided by an axial bushing 32. Leakage of high pressure liquid being pumped by the plunger 30 is prevented through the use of a suitable annular "chevron" packing 36 interposed between a spring 34 and a packing ring 46 adjacent a gland nut 38. The packing ring 46 includes a plurality of radially extended apertures 44 which conduct a lubrication liquid introduced through a fitting 40 and connecting passageway or tube 42 into an annular groove in the packing ring 46. The drive housing end of each of the reciprocating plungers 30 includes a suitable connecting bushing or nut 48 which will be understood to accomplish mechanical coupling of the plunger 30 to the rotating crank mechanism employed (not shown) in the drive housing 12, also as is conventional in the art.

Figure 4:
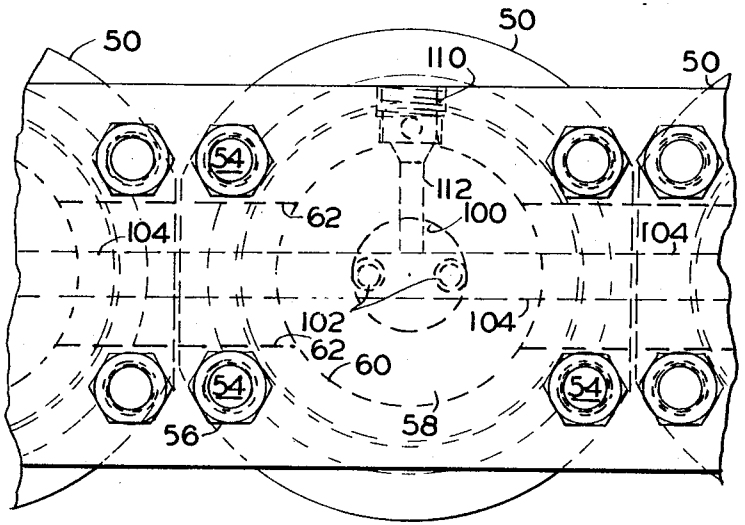
FIG. 4 is a partial end view of a three-cylinder pump in accordance with the invention looking in the direction of the arrows 4—4 in FIG. 2.

Surrounding the outer end of each of the pump cylinders 24 is a manifold mounting or adapter ring 50 which is threadably connected to a threaded end portion 52 formed adjacent the outer end face of the cylinder 24. As can be seen by reference to FIG. 4, each of the cylinders 24 is provided with an associated adapter ring 50 which have complimentary vertical flat portions formed on opposite sides thereof. Each of the adapter rings 50 provides the threadable mounting support for engaging a plurality of head studs 54, each having a suitable nut 56 for clamping the intake manifold 16 and the discharge manifold 18 on to the outer end face of each cylinder 24. In the embodiment shown, again with reference to FIGS. 2, 3 and 4, it will be seen that the intake or suction manifold 16 is provided with three circular cavities 60 which are in communication with each other through connecting ports 62. Each of the cavities 60 is adapted for receiving a valve seat assembly generally designated 58 therein. The valve seat assembly 58 includes a concave circular annulus 64 formed in the outer periphery thereof which communicates through a plurality of angularly disposed inlet passages 66 to a valve seat annular cavity designated as 68. The cavity 68 is located intermediate to adjacent valve seats or annular conical surfaces designated 70,70 which cooperate with similar surfaces formed on the truncated head of a suction valve 72. The suction valve 72 includes a cylindrical guide portion 73 having an outer diameter engaging a similarly sized central bore 74 formed in the valve seat 58. A conical head portion 76 of the suction valve 72 includes an extending annular retainer portion 77 enclosing and retaining a suction valve spring 78 formed in the internal recess of the spring retainer portion 77. The helical suction valve spring 78 includes a first end in abutting contact with a shoulder formed within the head portion 76 of the suction valve 72 and a second end portion engaging a circular recess 80 formed in a suction valve stop member 82 adjacent the end of the plunger 30. The suction valve stop 82 includes a plurality of radially arranged and spaced circular apertures 84 to allow for smooth inlet flow of liquid from the intake manifold cavity 60 through the passageways 66 past the outer and larger diameter suction valve seat 70 and into the cylinder chamber during the suction or withdrawal stroke of the plunger 30. The stop member 82 also includes an annular stop face surface 83 which provides the limiting surface against which the annular end surface of the retainer 77 will contact when the suction valve is in its fully open position.

As will be seen from the previously described relationship of the suction valve head parts and return spring 78, the diameter of the spring, which is less than the outside diameter of the guide portion 73, is effective to keep the return spring out of the fluid flow path of the liquid flowing into the plunger chamber during the suction or withdrawal stroke of the plunger. Furthermore, since relatively few sharp angular turns occur in the suction fluid flow path during the suction stroke, minimal pressure drop will occur to thereby improve volumetric efficiency.

As will be seen best from FIG. 3, the suction valve 72 includes a central discharge passageway 86 extending therethrough to direct fluid on the discharge stroke of plunger 30 toward and past a discharge valve 88 located on the opposite side of the seat assembly 58 from the suction valve 72. The discharge valve 88 is preferably of a configuration similar to that shown in applicant's prior patent, U.S. Pat. No. 4,277,229, and will be understood to include three or more radial guide ribs 90 whose outer edges engage the inner surface of the bore 74 formed in the valve seat 58. The discharge valve 88 includes a conical head portion 92 which engages a corresponding valve seat surface 94 formed in the valve seat assembly 58. The head 92 of the discharge valve 88 is also provided with a central guide stud 96 which engages and locates a surrounding helical discharge valve spring 98 whose opposite end is in contact with the end wall surface of a discharge cavity 100 formed in the discharge manifold 18. The discharge manifold 18 is further provided with a pair of discharge passageways 102,102 laterally adjacent the valve spring 98, which passageways communicate with a transversely extending connecting passageway 104 in the discharge manifold 18. It will be understood that the collective fluid discharged by each of the cylinders 24 through their respective discharge valves into their respective chambers 100 and thenceforth through passageways 102 into the connecting passageway 104 will be in communication with the conduit 20 in FIG. 1 through a suitable discharge fitting 108 securing the end of conduit 20 to the discharge manifold. The discharge manifold includes one or more threaded connector fittings 110 which will be understood to provide engagement with suitable pressure relief valves or pressure regulator valves (not shown) as is conventional in high pressure liquid pump systems.

With the foregoing mechanical design, it will be readily appreciated how applicant's invention has provided a unique and novel structural arrangement of the various elements of the combination so that alternatively either the fluid or liquid end of the pump may be readily disassembled in the field without disturbance of the stuffing box and cylinder portion of the pump for routine maintenance. Alternatively, should maintenance be required to the packing of the stuffing box, work thereon may also be readily accomplished without the need to disassemble the fluid end of the pump. This optimum arrangement of parts, in effect, using the adapter ring 50 as the datum plane for the pump assembly allows the individual maintenance of those parts on either side thereof without affecting the parts on the other side of the datum plane defined by the mounting ring 50.

In addition, the optimized placement of the suction valve return spring internal of a retaining collar adjacent the discharge passageway bore extending through the center axis of the suction valve is effective to remove the spring from the suction fluid flow path during the suction stroke of the plunger 30 and to place it rather in the discharge flow path. This greatly enhances the volumetric efficiency of the pump by minimizing the flow resistance during the suction stroke. In addition, the central location of the suction valve return spring and its minimum diameter tends to concentrate its valve seating force along the central axis of the suction valve, making it seat quicker and more assuredly about its entire seat periphery, again to accomplish optimized volumetric efficiency.

While a specific embodiment of the invention has been shown and described in detail to illustrate the application of the inventive principals, it will be understood that the invention may be embodied otherwise without departing from such principals.

What is claimed is:

1. In a high pressure in-line valve liquid reciprocating pump including a pump drive housing and a reciprocating plunger, the improvement comprising, a cylinder and stuffing box means surrounding said plunger, first independent securing means fixedly attaching a first end of said cylinder and stuffing box means to said drive housing, said cylinder and stuffing box means having a second end including a threaded portion about the outer end periphery thereof, mounting adapter ring means threadably secured to said threaded portion, suction manifold means having a first face in contact with said second end and a second face in a plane parallel to said first face, discharge manifold means in contact with said second face; suction and discharge valve assembly means disposed within an interior cavity of said suction manifold means and including a suction valve adjacent said second end and axially aligned with the axis of said plunger and a discharge valve adjacent said discharge manifold means and axially aligned with the axis of said plunger, and second independent securing means fixedly attaching said suction and discharge manifold means and valve assembly means as a unit to said mounting adapter ring means, whereby either the manifold end of said pump or the cylinder and stuffing box end of said pump may be disassembled independently of the other end for easy field maintenance thereof.

2. The combination of claim 1 wherein said suction and discharge valve assembly means includes a valve seat means, said seat means having a suction valve seat and a discharge valve seat, a central bore extending between said suction valve seat and said discharge valve seat, a concave semi-circular annulus formed in the outer peripheral surface of said valve seat means, a plurality of suction passageways communicating between said annulus and said suction valve seat, said suction valve including a central guide in engagement with said central bore and having a central passageway extending axially therethrough to place the cylinder in fluid communication with the discharge valve during the discharge stroke of said plunger, and a helical suction valve spring normally biasing the suction valve against the suction valve seat, said valve spring having an inside diameter slightly larger than said central passageway and an outside diameter less than the diameter of said central bore, whereby the volumetric efficiency of said pump is enhanced by placement of the inherent obstruction of said suction valve spring in the high pressure discharge flow path from said cylinder rather than in the low pressure suction flow path of fluid entering said cylinder during the suction stroke of said plunger and whereby the minimum diameter of said suction valve spring relative to the diameter of the suction valve seat is effective to centrally concentrate the suction valve spring return force upon said suction valve to enhance positive seating thereof with said suction valve seat during the discharge stroke of said plunger.

3. The combination of claim 2 wherein said suction valve includes a head portion having a raised hollow cylindrical portion surrounding and retaining said suction valve spring.

4. The combination of claim 3 wherein said cylinder and stuffing box means include stop means located between said plunger and said suction valve, said stop means including a central recessed portion for engaging and locating one end of said suction valve spring, said stop means also including a plurality of aperatures therethrough radially disposed about said central recessed portion.

5. The combination of claim 4 wherein said stop means includes an annular stop face surrounding said recessed portion for contact with the end of said suction valve raised hollow cylindrical portion to thereby limit the movement of said suction valve during the suction stroke of said plunger.

6. The combination of claim 5 wherein said pump includes at least three individual cylinder and stuffing box means arranged in side by side relationship each having a respective mounting adapter ring means and wherein said second independent securing means is effective to secure said suction and discharge manifold means, as a unit, to the respective second ends of each of said cylinder and stuffing box means.

7. The combination of claim 6 including suction manifold passageways interconnecting each interior cavity of said suction manifold, and wherein said discharge manifold means includes connecting passageway means to receive the liquid discharged from each cylinder upon their respective discharge strokes.

8. In a high pressure in-line valve liquid reciprocating pump including a pump drive housing and a reciprocating plunger, the improvement comprising, a cylinder and stuffing box means surrounding said plunger, first independent securing means fixedly attaching a first end of said cylinder and stuffing box means to said drive housing, said cylinder and stuffing box means having a second end, mounting adapter ring means secured about said second end, suction manifold means having a first face in contact with said second end and a second face in a plane parallel to said first face, discharge manifold means in contact with said second face; suction and discharge valve assembly means disposed within an interior cavity of said suction manifold means and including a suction valve adjacent said second end and axially aligned with the axis of said plunger and a discharge valve adjacent said discharge manifold means and axially aligned with the axis of said plunger, and second independent securing means threadably engaging said mounting adapter ring means thereby fixedly attaching said suction and discharge manifold means and valve assembly means as a unit to said mounting ring adapter means, whereby either the manifold end of said pump or the cylinder and stuffing box end of said pump may be disassembled independently of the other end of said pump for easy field maintenance thereof.

9. The combination of claim 8 wherein said suction and discharge valve assembly means includes a valve seat means, said seat means having suction valve seat and a discharge valve seat, a central bore extending between said suction valve seat and said discharge valve seat, a concave semi-circular annulus formed in the outer peripheral surface of said valve seat means, a plurality of suction passageways communicating between said annulus and said suction valve seat, said suction valve including a central guide in engagement with said central bore and having a central passageway extending axially therethrough to place the cylinder in fluid communication with the discharge valve during the discharge stroke of said plunger, and a helical suction valve spring normally biasing the suction valve against the suction valve seat, said valve spring having an inside diameter slightly larger than said central passageway and an outside diameter less than the diameter of said central bore, whereby the volumetric efficiency of said pump is enhanced by placement of the inherent obstruction of said suction valve spring in the high pressure discharge flow path from said cylinder rather than in the low pressure suction flow path of fluid entering said cylinder during the suction stroke of said plunger and whereby the minimum diameter of said suction valve spring relative to the diameter of the suction valve seat is effective to centrally concentrate the suction valve spring return force upon said suction valve to enhance positive seating thereof with said suction valve seat during the discharge stroke of said plunger.

10. The combination of claim 9 wherein said pump includes at least three individual cylinder and stuffing box means arranged in side by side relationship each having a respective mounting adapter ring means and wherein said second independent securing means is effective to secure said suction and discharge manifold means, as a unit, to the respective second ends of each of said cylinder and stuffing box means.

11. The combination of claim 8 wherein said suction and discharge valve assembly means includes a generally cylindrical valve seat means having a first end face including a discharge valve seat defined therein, and a second end face having a suction valve seat defined therein, a central bore extending between said discharge valve seat and said suction valve seat, a concave semi-circulate annulus formed in the outer peripheral surface of said valve seat means, a plurality of conically converging suction passageways communicating between said annulus and said suction valve seat, and a suction including a central guide in engagement with said central bore, said suction valve having a central passageway extending axially therethrough for flow of fluid toward said discharge valve seat upon the discharge stroke of said pump and a head portion having a raised annular cylindrical cavity for surrounding and retaining a suction valve return spring therein, said cavity having a diameter less than the diameter of said central bore whereby the suction valve return spring force will be centrally concentrated upon said suction valve to enhance positive seating thereof with said suction valve seat.

12. The combination of claim 11 including a helical suction valve return spring disposed within said raised annular cylindrical cavity, said spring having an inside diameter slightly larger than the diameter of said central passageway.

13. The combination of claim 12 wherein the suction valve return spring also has an outside diameter less than the inside diameter of said central bore.

14. The combination of claim 13 further including a discharge valve including a central guide in engagement with said central bore.

* * * * *